US009786446B2

(12) United States Patent
Goto et al.

(10) Patent No.: US 9,786,446 B2
(45) Date of Patent: Oct. 10, 2017

(54) SWITCH

(71) Applicant: Kobe Steel, Ltd., Kobe-shi (JP)

(72) Inventors: Takashi Goto, Fujisawa (JP); Kazuo Katagiri, Hatano (JP)

(73) Assignee: Kobe Steel, Ltd., Kobe-shi (JP)

( * ) Notice: Subject to any disclaimer, the term of this patent is extended or adjusted under 35 U.S.C. 154(b) by 108 days.

(21) Appl. No.: 14/559,192

(22) Filed: Dec. 3, 2014

(65) Prior Publication Data

US 2015/0206665 A1 Jul. 23, 2015

(30) Foreign Application Priority Data

Jan. 17, 2014 (JP) ..... 2014-006971

(51) Int. Cl.
*H01H 1/02* (2006.01)

(52) U.S. Cl.
CPC ..... *H01H 1/02* (2013.01); *H01H 2201/022* (2013.01)

(58) Field of Classification Search
CPC ..... H01H 1/02; H01H 2201/022; H01H 9/30; H01H 9/302
USPC ..... 200/262, 12, 19.36, 16 R, 16 A, 16 C, 200/16 D, 17 R, 519, 343, 342, 83 L, 200/81.9 M, 404
See application file for complete search history.

(56) References Cited

U.S. PATENT DOCUMENTS 2,997,563 A * 8/1961 McKeough ..... H01H 33/32 200/82 B
4,296,394 A * 10/1981 Ragheb ..... H01H 5/02 200/404
4,611,187 A * 9/1986 Banfi ..... H01H 77/104 335/16
5,227,774 A * 7/1993 Benoist ..... G08B 3/1058 200/517
6,246,020 B1 6/2001 Sato

FOREIGN PATENT DOCUMENTS

| | | | |
|---|---|---|---|
| CN | 101582345 | A | 11/2009 |
| CN | 103155071 | A | 6/2013 |
| EP | 1 722 383 | A1 | 11/2006 |
| EP | 2 120 242 | A1 | 11/2009 |
| JP | 49-97770 | U | 12/1974 |
| JP | 58-90613 | U | 6/1983 |
| JP | 63-102149 | U | 7/1988 |
| JP | 11 73848 | | 3/1999 |
| JP | 2003 311434 | | 11/2003 |
| JP | 2006-172847 | A | 6/2006 |
| JP | 2007 253182 | | 10/2007 |

* cited by examiner

*Primary Examiner* — Anthony R. Jimenez
(74) *Attorney, Agent, or Firm* — Oblon, McClelland, Maier & Neustadt, L.L.P.

(57) ABSTRACT

A switch includes a first arm that is rotatably supported, a first contact member that is provided at a free end of the first arm, a second arm that is rotatably supported, and a second contact member that is provided at a free end of the second arm and is to come into contact with the first contact member. After the first contact member and the second contact member have come into contact with each other, a point of contact between the first contact member and the second contact member is displaced with rotational motions of the first arm and the second arm.

8 Claims, 4 Drawing Sheets

SWITCH

BACKGROUND OF THE INVENTION

1. Field of the Invention

The present invention relates to a switch. More particularly, the present invention relates to a switch to which a pulsed high current is supplied.

2. Description of the Related Art

In a technique such as electromagnetic forming in which a metal material is plastically processed by utilizing an electromagnetic force, various kinds of forming is performed, for example, pipe expansion, flanging, pipe swaging, sheet metal forming, and so forth. In electromagnetic forming, an object of forming is positioned near an inductor, and energy charged in a capacitor is supplied as a pulsed high current to the inductor for an extremely short period of time of several milliseconds or shorter. Thus, magnetic flux is generated, and an induced current flows through the object of forming. Consequently, in accordance with the Fleming's left-hand rule, the object of forming is deformed plastically.

A gap switch as a pulsed current switch used in electromagnetic forming or the like is disclosed by Japanese Unexamined Patent Application Publication No. 2003-311434. In a gap switch, the discharging gap, i.e., the distance between electrodes, needs to be adjusted in accordance with conditions, such as humidity, of an ambient environment. Such circumstances increase the variation in the amount of deformation of the object of forming. Hence, the gap switch is not suitable for mass production.

In addition to the gap switch, Japanese Unexamined Patent Application Publication No. 2007-253182 proposes a thyratron switch, a semiconductor switch, and an ignitron switch as exemplary pulsed current switches. Among these switches, the ignitron switch is considered to be most suitable as a switch used in a mass production process in which discharge, i.e., shot, is caused for a number of times by supplying a pulsed high current to the switch.

Another option is a mechanical switch to which a current is supplied by mechanically bringing contact members into contact with each other. An exemplary mechanical switch applied to a case where a high current is used is disclosed by Japanese Unexamined Patent Application Publication No. 11-73848. In this mechanical switch, the materials of contact members have specific compositions, respectively, so that the adhesion, i.e., fusion, between the contact members is suppressed.

The degree of fusion may be reduced in the mechanical switch disclosed by Japanese Unexamined Patent Application Publication No. 11-73848. However, for example, in a case of a facility intended for mass production of electromagnetically formed products where discharge is caused successively for a number of times, the switch soon becomes unusable unless the occurrence of fusion is completely avoided, resulting in a reduction in the productivity and an increase in the cost.

SUMMARY OF THE INVENTION

The present invention provides a switch in which the occurrence of fusion between contact members is prevented so that a pulsed high current can be supplied to the switch successively for a number of times.

According to an aspect of the present invention, there if provided a switch including a first arm that is rotatably supported, a first contact member that is provided at a free end of the first arm, a second arm that is rotatably supported, and a second contact member that is provided at a free end of the second arm and is to come into contact with the first contact member. After the first contact member and the second contact member have come into contact with each other, a point of contact between the first contact member and the second contact member is displaced with rotational motions of the first arm and the second arm.

The switch according to the above aspect of the present invention may further include a displacing mechanism that displaces the point of contact. Furthermore, the displacing mechanism may displace the point of contact by causing the first arm to rotate in such a manner as to push back the second arm after the first contact member and the second contact member have come into contact with each other.

In the switch according to the above aspect of the present invention, the displacing mechanism may include an elastic member that applies, to the first arm, an elastic force that pushes back the second arm.

In the switch according to the above aspect of the present invention, an axis of rotation of the first arm and an axis of rotation of the second arm may be positioned on opposite sides with respect to the point of contact between the first contact member and the second contact member, or the axis of rotation of the first arm and the axis of rotation of the second arm may be positioned on the same side with respect to the point of contact between the first contact member and the second contact member.

The switch according to the above aspect of the present invention may further include an annular member that surrounds an area where the first contact member and the second contact member are to come into contact with each other.

In the switch according to the above aspect of the present invention, the annular member may be made of a resin material.

The switch according to the above aspect of the present invention may further include a housing that houses the first arm, the second arm, and the annular member.

In the switch according to the above aspect of the present invention, the housing may have a gas inlet.

In the switch according to the above aspect of the present invention, air in the housing may have been replaced with an inert gas or hydrogen gas.

According to the above aspect of the present invention, a switch to which a pulsed high current can be supplied successively for a number of times is provided.

DESCRIPTION OF THE PREFERRED EMBODIMENTS

Embodiments of the present invention will now be described in detail. The present invention is not limited to the following embodiments.

First Embodiment

Switch 1

Figure 1A:
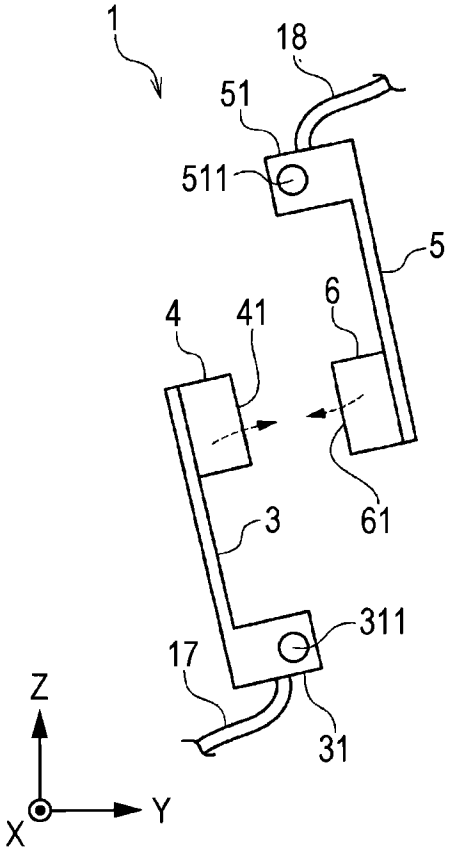
FIG. 1A is a front view of a switch according to a first embodiment of the present invention and illustrates an exemplary initial state of the switch.
Figure 1B:
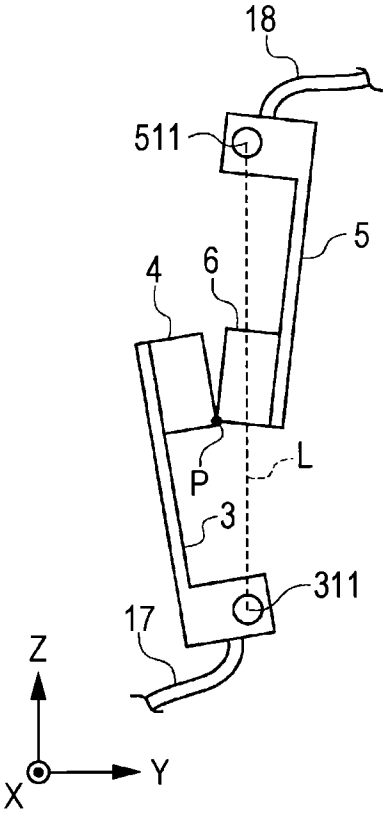
FIG. 1B is a front view of the switch according to the first embodiment of the present invention and illustrates an exemplary state of the switch where contact members start to come into contact with each other.
Figure 1C:
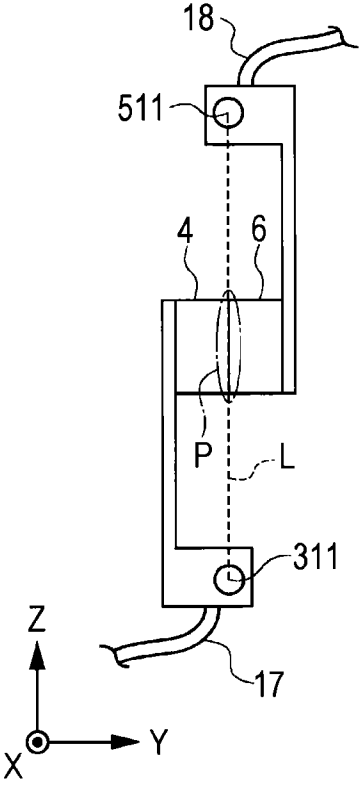
FIG. 1C is a front view of the switch according to the first embodiment of the present invention and illustrates an exemplary state of the switch where displacement of a point of contact between the contact members has ended.

A switch 1 according to a first embodiment of the present invention will first be described. FIGS. 1A to 1C are schematic front views of the switch 1 according to the first embodiment. In the following description, directions are defined as follows with reference to the axes illustrated in FIGS. 1A to 1C: the positive side in the X-axis direction corresponds to the front side, the negative side in the X-axis direction corresponds to the rear side, the positive side in the Y-axis direction corresponds to the right side, the negative side in the Y-axis direction corresponds to the left side, the positive side in the Z-axis direction corresponds to the upper side, and the negative side in the Z-axis direction corresponds to the lower side. In addition, in the following description, the positive and negative X-axis directions are collectively referred to the depth direction, the positive and negative Y-axis directions are collectively referred to as the horizontal direction, and the positive and negative Z-axis directions are collectively referred to as the height direction.

The switch 1 according to the first embodiment is applicable to a case where accumulated energy is discharged for a short time, and is suitable for a case where a pulsed high current is supplied to the switch. Specifically, as illustrated in FIGS. 1A to 1C, the switch 1 includes a first arm 3, a first contact member 4, a second arm 5, and a second contact member 6.

The first arm 3 extends from the upper side toward the lower side. The first arm 3 has, excluding a lower end thereof, a long plate-like shape with a predetermined width in the depth direction. The first arm 3 is rotatably supported at the lower end thereof. Specifically, the lower end of the first arm 3 serves as a first supported portion 31 having a rectangular shape in front view. The first supported portion 31 is provided with a first supporting shaft 311 extending therethrough in the depth direction. The first supporting shaft 311 serves as an axis of rotation of the first arm 3.

The first arm 3 is rotatably supported at the first supported portion 31 by the first supporting shaft 311. The first supporting shaft 311 is fixed to a position of the switch 1 that is predetermined for the fixation of the first supporting shaft 311.

The first arm 3 is made of a conducting material. The conducting material is preferably metal from a viewpoint of providing satisfactory conductivity and strength, or more preferably copper, a copper alloy, tungsten, or the like. The copper alloy is preferably brass or the like from viewpoints of cost, easiness of processing, and so forth. The first supporting shaft 311 is preferably made of an insulating material from a viewpoint of insulation from the first arm 3. The insulating material may be fiber reinforced plastic (FRP) or the like. From a viewpoint of allowing the first arm 3 to rotate smoothly, a lubricator is preferably provided between the first supporting shaft 311 and the first arm 3. The lubricant may be grease or the like.

The first contact member 4 is provided at a free end, i.e., an upper end, of the first arm 3. Specifically, the first contact member 4 is rotatable together with the first arm 3 that supports the first contact member 4. The first contact member 4 is provided at the upper end and on a right side face of the first arm 3 and projects from the first arm 3 toward the right side.

The shape of the first contact member 4 is not limited and may be any shape such as a substantially round column-like shape or a substantially rectangular column-like shape. A right side face 41 of the first contact member 4 is preferably a flat surface from a viewpoint of smoothly displacing a point of contact P between the first contact member 4 and the second contact member 6, which will be described separately below. The right side face 41 of the first contact member 4 preferably has as large an area as possible from a viewpoint of appropriately allowing a current to flow between the two contact members 4 and 6 by minimizing the influence of skin effect caused by high-frequency discharge that may occur between the contact members 4 and 6.

The first contact member 4 is made of a conducting material. The conducting material is preferably metal from a viewpoint of providing satisfactory conductivity and strength, or more preferably copper, a copper alloy, tungsten, or the like. The copper alloy is preferably brass from viewpoints of cost, easiness of processing, unlikeliness of melting of the first contact member 4, and so forth.

The second arm 5 extends from the lower side toward the upper side. The second arm 5 has, excluding an upper end thereof, a long plate-like shape with a predetermined width in the depth direction. A lower end of the second arm 5 is on the right side with respect to the upper end of the first arm 3. The second arm 5 is rotatably supported at the upper end thereof. Specifically, the upper end of the second arm 5 serves as a second supported portion 51 having a rectangular shape in front view. The second supported portion 51 is provided with a second supporting shaft 511 extending therethrough in the depth direction. The second supporting shaft 511 serves as an axis of rotation of the second arm 5.

The second arm 5 is rotatably supported by the second supporting shaft 511. The second arm 5 is made of the same conducting material as the first arm 3. The second supporting shaft 511 is preferably made of an insulating material, such as fiber reinforced plastic, from a viewpoint of insulation from the second arm 5. From a viewpoint of allowing the second arm 5 to rotate smoothly, a lubricator, such as grease, is preferably provided between the second supporting shaft 511 and the second arm 5.

The second contact member 6 is provided at a free end, i.e., the lower end, of the second arm 5. Specifically, the second contact member 6 is rotatable together with the second arm 5 that supports the second contact member 6. The second contact member 6 is provided at the lower end and on a left side face of the second arm 5 and projects from the second arm 5 toward the left side. The second contact member 6 faces the first contact member 4 from the right side. The shape of the second contact member 6 is not limited and may be any shape such as a substantially round column-like shape or a substantially rectangular column-like shape. The second contact member 6 is made of the same conducting material as the first contact member 4.

The second contact member 6 is to come into contact with the first contact member 4. The second contact member 6 and the first contact member 4 in combination allow the first arm 3 and the second arm 5 to be electrically continuous with each other.

The switch 1 is configured such that, after the first contact member 4 and the second contact member 6 come into contact with each other, the point of contact P between the two contact members 4 and 6 is displaced, i.e., moved, with the rotational motions of the first arm 3 and the second arm 5. To displace the point of contact P between the contact members 4 and 6, the speeds and the directions of rotation or the torques of the arms 3 and 5, the angle between the first contact member 4 and the second contact member 6 at the contact between the contact members 4 and 6, or the like may be adjusted according to need. Alternatively, a mechanism that displaces the point of contact P between the first contact member 4 and the second contact member 6 may be added.

As illustrated in FIG. 1B, the first supporting shaft 311 and the second supporting shaft 511 are positioned on opposite sides with respect to the point of contact P between the first contact member 4 and the second contact member 6. The positional relationship between the two supporting shafts 311 and 511 that are on the opposite sides with respect to the point of contact P is retained regardless of the displacement of the point of contact P. In such a configuration, the width of the switch 1 can be reduced, and the size of the switch 1 as a whole can be reduced.

As illustrated in FIGS. 1A to 1C, a first lead wire 17 is connected to the lower end of the first arm 3, and a second lead wire 18 is connected to the upper end of the second arm 5. The first lead wire 17 and the second lead wire 18 are connected to a power supply and a load (both not illustrated). The load may be an inductor intended for electromagnetic forming, or the like. The lead wires 17 and 18 may each be a multi-conductor round cable or the like.

Exemplary Operation of Switch 1

An exemplary operation of the switch 1 will now be described. In the initial state illustrated in FIG. 1A, the first contact member 4 and the second contact member 6 are out of contact with each other, and no pulsed current flows therebetween.

When, for example, a power is transmitted from a power source (not illustrated) to the first arm 3 and the second arm 5 that are in the initial state, the arms 3 and 5 rotate. In this step, the first arm 3 rotates clockwise in FIG. 1A about the first supporting shaft 311, and the second arm 5 also rotates clockwise in FIG. 1A about the second supporting shaft 511. The two broken-line arrows illustrated in FIG. 1A indicate the directions of rotation of the respective arms 3 and 5.

With such rotational motions of the first arm 3 and the second arm 5, referring now to FIG. 1B, the first contact member 4 and the second contact member 6 start to come into contact with each other. In this step, the point of contact P between the contact members 4 and 6 is on the left side, i.e., on a side nearer to the first contact member 4, with respect to a virtual line L connecting the center of the first supporting shaft 311 and the center of the second supporting shaft 511. In the state illustrated in FIG. 1B, the point of contact P between the contact members 4 and 6 is defined by a point near the lower end of the right side face 41 of the first contact member 4 and the lower end of a left side face 61 of the second contact member 6. Depending on the sizes of the contact members 4 and 6 or other conditions, the lower end of the right side face 41 of the first contact member 4 may come into contact with a point near the lower end of the left side face 61 of the second contact member 6.

The point of contact P in the state illustrated in FIG. 1B where the contact members 4 and 6 start to come into contact with each other may be established by, for example, making the speed of rotation of the second arm 5 higher than that of the first arm 3. In that case, as illustrated in FIGS. 1A and 1B, it is preferable that the first arm 3 be rotated in a direction against the gravitational force acting on the first contact member 4, i.e., clockwise, and the second arm 5 be rotated in a direction of the gravitational force acting on the second contact member 6, i.e., clockwise. Thus, the gravitational force acting on the first contact member 4 acts in such a direction as to prevent the rotation of the first arm 3, while the gravitational force acting on the second contact member 6 acts in such a direction as to promote the rotation of the second arm 5. Hence, a difference in the speed of rotation between the arms 3 and 5 can be produced efficiently.

In the state illustrated in FIG. 1B, the first arm 3 and the second arm 5 are electrically continuous with each other and are also electrically continuous with the external power supply via the respective lead wires 17 and 18 connected thereto. Therefore, a pulsed current flows between the first arm 3 and the second arm 5 on the basis of the energy generated by the power supply.

After the step illustrated in FIG. 1B, the first arm 3 further rotates clockwise, whereby, referring now to FIG. 1C, the first contact member 4 and the second contact member 6 move to respective positions where the displacement of the point of contact P therebetween ends. In this state, the point of contact P between the contact members 4 and 6 lies on the virtual line L. In this state, the entirety of the right side face 41 of the first contact member 4 and the entirety of the left side face 61 of the second contact member 6 may be in surface contact with each other. FIG. 1C illustrates a state where the displacement of the point of contact P has ended and the contact members 4 and 6 are in surface contact with each other in the area encircled by the dash-dot line.

The state illustrated in FIG. 1C where the displacement of the point of contact P between the contact members 4 and 6 has ended is established in a configuration in which the direction of rotation of the second arm 5 is reversed, i.e., changed to the counterclockwise direction, at the point of time illustrated in FIG. 1B.

Then, the first arm 3 and the second arm 5 that are in the state illustrated in FIG. 1C are rotated counterclockwise by, for example, controlling the power source, whereby the first arm 3 and the second arm 5 are returned to the respective initial positions (as illustrated in FIG. 1A). Thereafter, the change to the state illustrated in FIG. 1B, to the state illustrated in FIG. 1C, and to the state illustrated in FIG. 1A is repeated sequentially.

When the first contact member 4 and the second contact member 6 come into contact with each other, a discharge (a spark) may occur in the gap between the contact members 4 and 6 because of the potential difference between the contact members 4 and 6, and the discharge may partially melt the contact members 4 and 6. If such melted portions of the contact members 4 and 6 are solidified while the contact members 4 and 6 are in contact with each other, the contact members 4 and 6 are fused to each other.

Figure 2A:
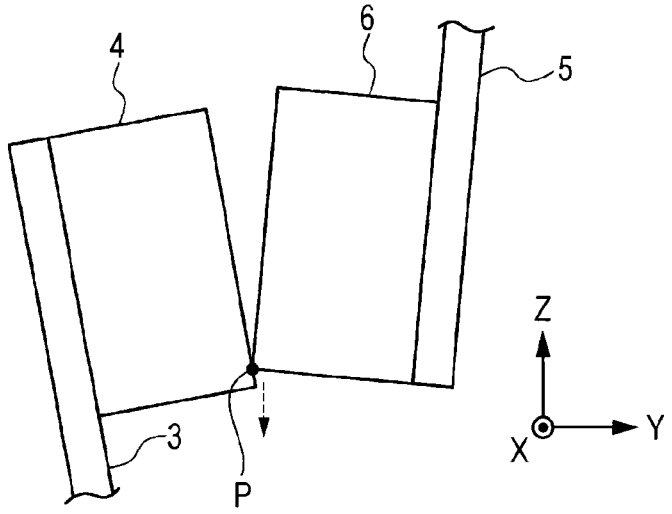
FIGS. 2A to 2C are enlarged front views of the switch and illustrate how the point of contact between the contact members is displaced.
Figure 2B:
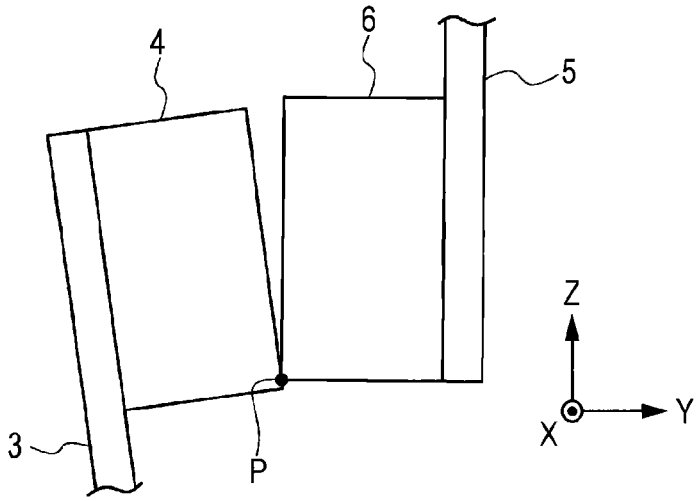
Figure 2C:
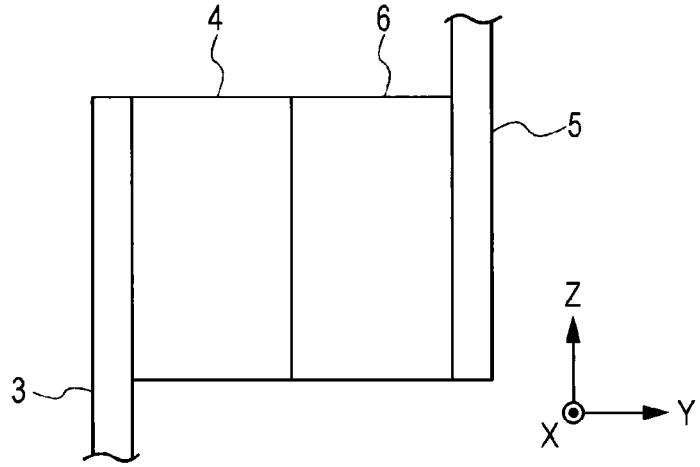

However, in the switch 1 according to the first embodiment, as illustrated in FIGS. 2A to 2C, the point of contact P between the first contact member 4 and the second contact member 6 continues to be displaced during a period from when the contact members 4 and 6 start to come into contact with each other (as illustrated in FIG. 2A) until when the displacement of the point of contact P ends (as illustrated in FIG. 2C). More specifically, in the case illustrated in FIGS. 2A to 2C, the point of contact P is displaced downward with time. The broken-line arrow illustrated in FIG. 2A indicates the direction of displacement of the point of contact P. Thus, the melted portions of the contact members 4 and 6 are prevented from being solidified while being in contact with each other. Therefore, the contact members 4 and 6 are not fused to each other. The direction of displacement of the point of contact P between the first contact member 4 and the second contact member 6 is not limited to the downward direction as illustrated in FIGS. 2A to 2C and may be, for example, the depth direction.

As described above, in the switch 1 according to the first embodiment, the point of contact P between the first contact member 4 and the second contact member 6 is displaced with the rotational motions of the first arm 3 and the second arm 5, whereby the contact members 4 and 6 are prevented from being fused to each other. Hence, the contact members 4 and 6 can be brought into contact with and moved away from each other repeatedly. Accordingly, a pulsed high current can be supplied to the switch 1 successively for a number of times.

Furthermore, in the switch 1 according to the first embodiment, the contact members 4 and 6 start to come into contact with each other in a state where no axial compressive forces are applied to the contact members 4 and 6, i.e., in a state where the side faces 41 and 61 of the contact members 4 and 6 are tilted with respect to each other (see FIG. 1B). Hence, the contact members 4 and 6 are more effectively prevented from being fused to each other.

Furthermore, in the switch 1 according to the first embodiment, as the contact members 4 and 6 repeatedly come into contact with each other and thus melt, the shapes of the contact members 4 and 6 gradually change. Hence, the point of contact P established when the contact members 4 and 6 start to come into contact with each other changes every time the current is supplied to the switch 1. Thus, the contact members 4 and 6 are prevented from melting away concentratedly in specific portions thereof. Consequently, the life of the switch 1 is extended.

Second Embodiment

Switch 12

Figure 3:
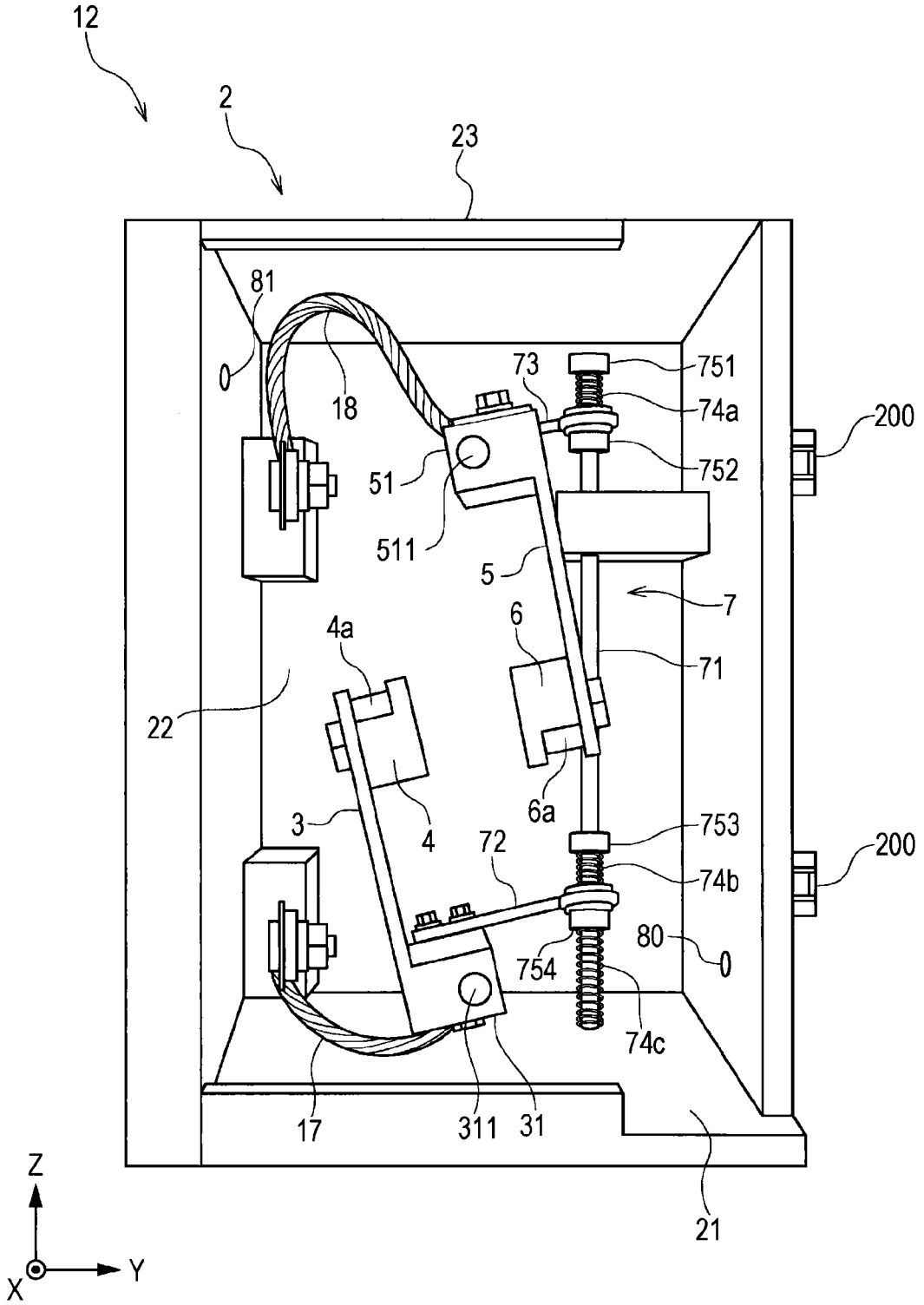
FIG. 3 is a front view of a switch according to a second embodiment of the present invention.

A switch 12 according to a second embodiment of the present invention will now be described. FIG. 3 is a front view of the switch 12 according to the second embodiment of the present invention.

The switch 12 according to the second embodiment has a more specific configuration than the switch 1 according to the first embodiment.

Specifically, as illustrated in FIG. 3, the switch 12 includes a housing 2 that houses the elements 3 to 6 and 17 and 18 described in the first embodiment. FIG. 3 illustrates the switch 12 with a front wall (not illustrated) of the housing 2 being open. The front wall may be openably and closably supported by opening/closing members 200 such as hinges.

As illustrated in FIG. 3, the first arm 3 is provided at a position in the housing 2 that is near a bottom wall 21 of the housing 2. The first arm 3 is rotatably supported by the first supporting shaft 311 that is fixed to a rear wall 22 of the housing 2.

As illustrated in FIG. 3, the second arm 5 is provided at a position in the housing 2 that is near an upper wall 23 of the housing 2. The second arm 5 is rotatably supported by the second supporting shaft 511 that is fixed to the rear wall 22 of the housing 2.

As illustrated in FIG. 3, the switch 12 includes an arm-moving mechanism 7 that moves the first arm 3 and the second arm 5.

The configuration of the arm-moving mechanism 7 is not limited and may include, as illustrated in FIG. 3, an arm-moving shaft 71, a first arm-connecting member 72, a second arm-connecting member 73, and three elastic members 74*a* to 74*c*.

The arm-moving mechanism 7 illustrated as an example in FIG. 3 will further be described. As illustrated in FIG. 3, the arm-moving shaft 71 has a long shape extending in the height direction and is supported in the housing 2 in such a manner as to be vertically slidable.

The three elastic members 74*a* to 74*c* each exert an elastic force against a compressive force applied thereto from an external device. The elastic members 74*a* to 74*c* may each be, but is not limited to, a compression spring, a rubber cushion, an air damper, or the like. The elastic members 74*a* to 74*c* are provided at different positions of the arm-moving shaft 71 in such a manner as to exert their elastic forces in the axial direction of the arm-moving shaft 71.

Specifically, the elastic member 74*a* (hereinafter referred to as the first elastic member 74*a*) is provided at an upper end of the arm-moving shaft 71 in such a manner as to surround the arm-moving shaft 71. More specifically, an upper end of the first elastic member 74*a* is connected to a lower end face of a first flange 751 that is fixed to the outer circumference of the arm-moving shaft 71, and a lower end of the first elastic member 74*a* is connected to a right end of the second arm-connecting member 73. The right end of the second arm-connecting member 73 is connected to the first elastic member 74*a* while surrounding the arm-moving shaft 71. The right end of the second arm-connecting member 73 is also in contact with an upper end face of a second flange 752 that is fixed to the outer circumference of the arm-moving shaft 71.

The elastic member 74*c* (hereinafter referred to as the third elastic member 74*c*) is provided at a lower end of the arm-moving shaft 71 in such a manner as to surround the arm-moving shaft 71. More specifically, an upper end of the third elastic member 74*c* is connected to a lower end face of a fourth flange 754 that is fixed to the outer circumference of the arm-moving shaft 71, and a lower end of the third elastic member 74*c* is connected to the bottom wall 21 of the housing 2.

The elastic member 74*b* (hereinafter referred to as the second elastic member 74*b*) is provided at a position of the arm-moving shaft 71 that is above and near the third elastic member 74*c* in such a manner as to surround the arm-moving shaft 71. More specifically, an upper end of the second elastic member 74*b* is connected to a lower end face of a third flange 753 that is fixed to the outer circumference of the arm-moving shaft 71, and a lower end of the second elastic member 74*b* is connected to a right end of the first arm-connecting member 72. The right end of the first arm-connecting member 72 is connected to the second elastic member 74*b* while surrounding the arm-moving shaft 71. The right end of the first arm-connecting member 72 is also in contact with an upper end face of the fourth flange 754.

The first elastic member 74*a* and the second elastic member 74*b* in combination function as a displacing mechanism that displaces the point of contact P between the first contact member 4 and the second contact member 6. The displacing mechanism will be described in detail separately below.

When no external force is applied to the arm-moving shaft 71, the arm-moving shaft 71 is retained at the upper extreme end of its slidable range with the elastic force exerted by the third elastic member 74*c*. It is possible to apply to the arm-moving shaft 71 a downward external force that is greater than the upward elastic force exerted by the third elastic member 74*c*. For example, a magnetically acting unit (not illustrated) including a ferromagnetic member or the like may be provided to the arm-moving shaft 71, and a solenoid that generates a magnetic field extending in the axial direction of the arm-moving shaft 71 may also be provided around the magnetically acting unit, so that the magnetically acting unit can generate a downward magnetic force. In such a configuration, to avoid damaging the solenoid with the leakage of the current from the arms 3 and 5 while the current is supplied to the switch 12, the arm-moving shaft 71 is preferably made of an insulating material. The insulating material is preferably fiber reinforced plastic or the like from viewpoints of providing satisfactory strength to the arm-moving shaft 71, reducing the weight of the arm-moving shaft 71, and so forth.

The first arm-connecting member 72 connects the first arm 3 to a position of the arm-moving shaft 71 that is near the lower end of the arm-moving shaft 71. As described above, the first arm-connecting member 72 and the arm-moving shaft 71 are connected to each other with the second elastic member 74*b* interposed therebetween. The first arm-connecting member 72 is preferably made of fiber reinforced plastic or the like from viewpoints of insulation from the first arm 3 and providing satisfactory strength to the first arm-connecting member 72.

The second arm-connecting member 73 connects the second arm 5 to a position of the arm-moving shaft 71 that is near the upper end of the arm-moving shaft 71. As described above, the second arm-connecting member 73 and the arm-moving shaft 71 are connected to each other with the first elastic member 74*a* interposed therebetween. The second arm-connecting member 73 is preferably made of fiber reinforced plastic or the like from viewpoints of insulation from the second arm 5 and providing satisfactory strength to the second arm-connecting member 73.

In addition to the above configuration, the housing 2 may have a gas inlet 80 as illustrated in FIG. 3. Furthermore, air in the housing 2 may be replaced with an inert gas or hydrogen gas supplied into the housing 2 from an external gas supply source through the gas inlet 80. The inert gas may be nitrogen gas, argon gas, or the like. In such a configuration, the contact members 4 and 6 are prevented from being oxidized, and the generation of a spark at the discharge between the contact members 4 and 6 is suppressed. The housing 2 may also have a gas outlet 81.

If the gas supplied into the housing 2 is heavier than air, the gas inlet 80 is preferably provided at a position near the bottom of the housing 2, and the gas outlet 81 is preferably provided at a position near the top of the housing 2 as illustrated in FIG. 3. In such a configuration, after the housing 2 is fully filled with the gas, an extra amount of gas is exhausted from the housing 2. Therefore, the contact members 4 and 6 are more effectively prevented from being oxidized, and the generation of a spark at the discharge between the contact members 4 and 6 is more effectively suppressed.

The contact members 4 and 6 are preferably attachable to and detachable from the respective arms 3 and 5 from viewpoints of easiness of maintenance, easiness of assembling, and so forth. In such a configuration, the contact members 4 and 6 may be attached to or detached from the arms 3 and 5 by a simple work of fastening or loosening female screws provided to the respective arms 3 and 5 and male screws provided to the contact members 4 and 6. In such a case, as illustrated in FIG. 3, the outer surface of each of the contact members 4 and 6 may include a flat surface 4*a* or 6*a* so that a wrench used in attaching or detaching the contact member 4 or 6 can easily catch the contact member 4 or 6.

Furthermore, fins for radiating heat of the contact members 4 and 6 may be provided on the arms 3 and 5.

Furthermore, the power source provided for the arm-moving shaft 71 is not limited to a solenoid and may be any of other various power sources that are capable of vertically moving the arm-moving shaft 71.

Exemplary Operation of Switch 12

An exemplary operation of the switch 12 according to the second embodiment will now be described. In the switch 12 according to the second embodiment, the initial state illustrated in FIG. 1A is established by the elastic force, i.e., an upward force, exerted by the third elastic member 74*c* and acting on the arm-moving shaft 71.

Subsequently, the state illustrated in FIG. 1B in which the first contact member 4 and the second contact member 6 start to come into contact with each other is established by a downward external force acting on the arm-moving shaft 71. Specifically, the downward external force acting on the arm-moving shaft 71 moves the arm-moving shaft 71 downward against the elastic force exerted by the third elastic member 74*c*. In this step, the third elastic member 74*c* functions as a damper and stabilizes downward movement of the arm-moving shaft 71. Then, with the downward movement of the arm-moving shaft 71, the first arm 3 connected to the arm-moving shaft 71 rotates clockwise in FIG. 3 about the first supporting shaft 311, and the second arm 5 connected to the arm-moving shaft 71 rotates clockwise in FIG. 3 about the second supporting shaft 511. Thus, the contact members 4 and 6 come into contact with each other. The downward external force acting on the arm-moving shaft 71 may be applied repeatedly at regular time intervals by intermittently supplying a current to the solenoid from a power supply device (not illustrated).

Subsequently, the first elastic member 74*a* and the second elastic member 74*b*, which in combination function as an exemplary displacing mechanism, displaces the point of contact P between the first contact member 4 and the second contact member 6 as illustrated in FIGS. 2A to 2C. Specifically, when the arm-moving shaft 71 in the state where the contact members 4 and 6 start to come into contact with each other (see FIG. 1B) is further moved downward, the downward forces applied to the upper ends of the first elastic member 74*a* and the second elastic member 74*b* from the respective flanges 751 and 753 increase.

Hence, the first elastic member 74*a* and the second elastic member 74*b* are compressed from above. In response to this, the first elastic member 74*a* and the second elastic member 74*b* exert restoring forces, respectively, so as to resist the compression. Specifically, the first elastic member 74*a* exerts a force that pushes down the second arm-connecting member 73 connected to the lower end of the first elastic member 74*a*. That is, the first elastic member 74*a* exerts an elastic force that causes the second arm 5 to further rotate clockwise. Meanwhile, the second elastic member 74*b* exerts a force that pushes down the first arm-connecting member 72 connected to the lower end of the second elastic member 74*b*. That is, the second elastic member 74*b* exerts an elastic force that causes the first arm 3 to further rotate clockwise.

In this step, the elastic force exerted by the second elastic member 74*b* is larger than the elastic force exerted by the first elastic member 74*a* because of the difference between the elastic moduli of the respective elastic members 74*a* and 74*b*, and so forth. Hence, the clockwise rotation of the first arm 3 overrides the clockwise rotation of the second arm 5. Hence, the second arm 5 is pushed back by the first arm 3 at the point of contact P between the contact members 4 and 6 and rotates counterclockwise. Thus, the point of contact P between the contact members 4 and 6 is displaced downward, whereby the state illustrated in FIG. 1C is established. The mechanism of causing the first arm 3 to push back the second arm 5 is not limited to the above mechanism.

After the state illustrated in FIG. 1C is established, the application of the downward external force to the arm-moving shaft 71 is stopped, whereby the arm-moving shaft 71 is moved upward by the elastic force exerted by the third elastic member 74*c*. With the upward movement of the arm-moving shaft 71, the first arm 3 and the second arm 5 return to their initial positions (as illustrated in FIG. 1A).

In the switch 12 according to the second embodiment, the displacing mechanism (the elastic members 74*a* and 74*b*) causes the first arm 3 to rotate in such a manner as to push back the second arm 5 at the contact between the contact members 4 and 6, whereby the point of contact P between the contact members 4 and 6 is displaced simply and assuredly. Furthermore, the displacing mechanism (the elastic members 74*a* and 74*b*) includes the second elastic member 74*b* that applies to the first arm 3 an elastic force that pushes back the second arm 5. Therefore, the point of contact P is displaced with a simple mechanism and at a low cost. Furthermore, since the displacing mechanism (the elastic members 74*a* and 74*b*) is included in the arm-moving mechanism 7, the configuration of the switch 12 is more simplified. Furthermore, since the first supporting shaft 311 and the second supporting shaft 511 are positioned on the opposite sides with respect to the point of contact P between the contact members 4 and 6, one arm-moving shaft 71 included in the arm-moving mechanism 7 is used for moving both the first arm 3 and the second arm 5. Accordingly, the number of components is reduced.

Third Embodiment

Figure 4:
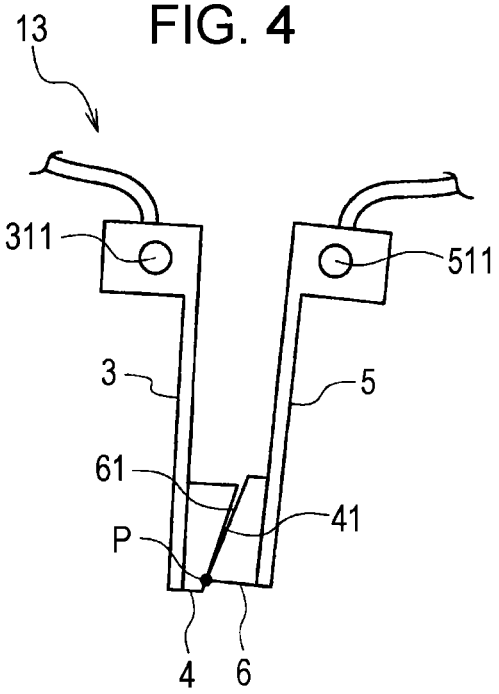
FIG. 4 is a front view illustrating a configuration of a switch according to a third embodiment of the present invention.

A switch 13 according to a third embodiment of the present invention will now be described. FIG. 4 illustrates a configuration of the switch 13 according to the third embodiment of the present invention.

The switch 13 according to the third embodiment differs from the switch 1 according to the first embodiment in the relative positions of the first supporting shaft 311 and the second supporting shaft 511 with respect to the point of contact P between the first contact member 4 and the second contact member 6. Specifically, as illustrated in FIG. 4, the third embodiment concerns a case where the first supporting shaft 311 and the second supporting shaft 511 are provided on the same side, more specifically, on the upper side in FIG. 4, with respect to the point of contact P.

Furthermore, as illustrated in FIG. 4, the right side face 41 of the first contact member 4 slopes with respect to the longitudinal direction of the first arm 3, and the left side face 61 of the second contact member 6 slopes with respect to the longitudinal direction of the second arm 5.

In the switch 13 according to the third embodiment, the first arm 3 and the second arm 5 rotate in the opposite directions so as to bring the first contact member 4 and the second contact member 6 into contact with each other. Specifically, the first arm 3 rotates counterclockwise in FIG. 4 while the second arm 5 rotates clockwise in FIG. 4, whereby the first contact member 4 and the second contact member 6 come into contact with each other.

The switch 13 according to the third embodiment is suitable for a case where the height of the switch needs to be reduced.

Fourth Embodiment

Figure 5:
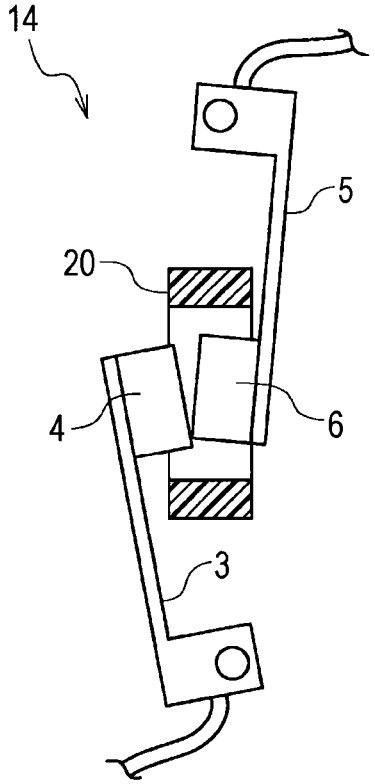
FIG. 5 is a front view illustrating a configuration of a switch according to a fourth embodiment of the present invention.

A switch 14 according to a fourth embodiment of the present invention will now be described. FIG. 5 illustrates a configuration of the switch 14 according to the fourth embodiment of the present invention.

The switch 14 according to the fourth embodiment differs from the switch 12 according to the second embodiment only in, as illustrated in FIG. 5, further including an annular member 20 that surrounds an area where the first contact member 4 and the second contact member 6 are to come into contact with each other. The annular member 20, together with the first arm 3 and the second arm 5, is housed by the housing 2 (see FIG. 3).

The annular member 20 is preferably made of an insulating material from a viewpoint of providing a satisfactory insulating characteristic, or more preferably made of a fluorocarbon resin from a viewpoint of providing satisfactory resistance to heat and impact. The fluorocarbon resin may be polytetrafluoroethylene or the like.

In the switch 14 according to the fourth embodiment, the annular member 20 protects the housing 2 from a jet stream produced at the contact between the first contact member 4 and the second contact member 6. Furthermore, even if some melted metal composing the contact members 4 and 6 is scattered by the jet stream, the scattering is suppressed within the annular member 20.

The annular member 20 may also be applied to the switch 13 according to the third embodiment.

What is claimed is:

1. A switch comprising:

a first arm supported for rotation about an axis;

a first contact member having a first contact face, wherein the first contact member is provided at a free end of the first arm;

a second arm supported for rotation about another axis;

a second contact member having a second contact face, wherein the second contact member is provided at a free end of the second arm, wherein in the absence of an external force to at least one of the first and second arms, the first arm and second arm are set at rotational positions about their respective axes such that the first and second contact faces are not in point or surface contact with each other, and an external force applied to at least one of the first and second arms rotates the first and second arms about their respective axes such that the first and second contact faces come into point contact with each other;

a displacing mechanism that displaces the point of the point contact of the first contact member and the second contact member along one of said first and second contact surfaces, after the first contact member and the second contact member have come into point contact with each other, such that the first and second contact surfaces make surface contact with each other, wherein the displacing mechanism displaces the point of contact of the first contact member and the second contact member by causing the first arm to rotate in such a manner as to push back the second arm in a direction opposite to the direction of the rotational motion of the second arm causing the first contact member and the second contact member to come into point contact with each other, after the first contact member and the second contact member have come into point contact with each other, and wherein the displacing mechanism includes at least one elastic member that applies, to the first arm, an elastic force that is able to push back the second arm in the direction opposite to the direction of the rotational motion of the second arm causing the first contact member and the second contact member to come into point contact with each other.

2. The switch according to claim 1, wherein the axis of rotation of the first arm and the axis of rotation of the second arm are positioned on opposite sides with respect to the point of contact between the first contact member and the second contact member.

3. The switch according to claim 1, further comprising an annular member that surrounds an area where the first contact member and the second contact member are to come into contact with each other.

4. The switch according to claim 3, wherein the annular member is made of a resin material.

5. The switch according to claim 4, wherein the at least one elastic member comprises two elastic members having different elastic moduli.

6. The switch according to claim 4, further comprising a housing that houses the first arm, the second arm, and the annular member.

7. The switch according to claim 6, wherein the housing has a gas inlet.

8. The switch according to claim 7, wherein air in the housing has been replaced with an inert gas or hydrogen gas.

* * * * *